United States Patent [19]

Fukasawa et al.

[11] 4,255,729

[45] Mar. 10, 1981

[54] HIGH FREQUENCY FILTER

[75] Inventors: Atsushi Fukasawa; Jun Ashiwa; Takuro Sato, all of Tokyo, Japan

[73] Assignee: Oki Electric Industry Co., Ltd., Tokyo, Japan

[21] Appl. No.: 37,419

[22] Filed: May 9, 1979

[30] Foreign Application Priority Data

May 13, 1978 [JP] Japan ..... 53-56160
May 29, 1978 [JP] Japan ..... 53-63360
Jan. 25, 1979 [JP] Japan ..... 54-7145[U]

[51] Int. Cl.[3] ..... H01P 1/201; H01P 7/00

[52] U.S. Cl. ..... 333/202; 333/219; 333/231; 333/245

[58] Field of Search ..... 333/202-212, 333/219-235, 245; 330/53-57; 334/41-45, 85; 331/96, 101-102

[56] References Cited

U.S. PATENT DOCUMENTS 2,516,056 7/1950 Keizer ..... 333/203
4,028,652 6/1977 Wakino et al. ..... 333/202 X
4,059,815 11/1977 Makimoto et al. ..... 333/202 X

OTHER PUBLICATIONS

Matthaei et al.,-"Microwave Filters, Impedance-Matching Networks, and Coupling Structures", McGraw-Hill, New York, 1964, pp. XII, 536-541.

*Primary Examiner*—Marvin L. Nussbaum
*Attorney, Agent, or Firm*—Armstrong, Nikaido, Marmelstein & Kubovcik

[57] ABSTRACT

A high frequency filter for frequencies higher than the VHF band comprising at least one resonator has been found. Each resonator comprises a conductive housing, an inner conductor one end of which is fixed at the bottom of the housing and the other end of which is free standing, a cylindrical dielectric body surrounding said inner conductor, and the diameter of the dielectric body is approximately four times as large as that of said inner conductor.

11 Claims, 42 Drawing Figures

HIGH FREQUENCY FILTER

BACKGROUND OF THE INVENTION

The present invention relates to improvement of a high frequency filter utilized in VHF, UHF, and microwave frequency bands.

The present filter can be utilized in radio communication apparatus in said frequency area for preventing interference from adjacent communication channels. Preferably, the present filter is utilized in the antenna circuit of a mobile communication system.

For that purpose, a filter employing a coaxial line type resonator has been utilized. Said resonator has an internal conductor, a cylindrical external coaxial conductor and a dielectric body between those conductors. The dielectric body is used for the purpose of reducing the size of a resonator and/or a filter.

FIG. 1(A) and FIG. 1(B) show the structure of a prior coaxial line type resonator utilized in a prior high frequency filter, in which FIG. 1(A) is a vertical sectional view, and FIG. 1(B) is a plane sectional view. In those figures, the reference numeral 1 is an inner conductor, 2 is a cylindrical external conductor arranged coaxially with the inner conductor 2. One extreme end of the inner conductor 1 is short-circuited with the external conductor 2, and the other extreme end of the inner conductor 1 is open. In this type of resonator, the following formulae are satisfied, where $\epsilon_r$ is relative dielectric constant of dielectric body 3, $\lambda_g$ is the wavelength in a coaxial line, $\lambda_O$ is the wavelength in free space, $f_O$ is the resonant frequency, C is the light velocity in free space, and l is the length of the resonator, and said length is the same as the length of the inner conductor 1.

$$l = \frac{1}{4}\lambda g \qquad (1)$$

$$\lambda g = \frac{1}{\sqrt{\epsilon_r}}\lambda o$$

$$fo = \frac{C}{\lambda_o}$$

As apparent from the above formulas, the larger the relative dielectric constant $\epsilon_r$ is, the shorter the length (l) of the resonator can be, and the size of the resonator can be reduced. On the other hand, supposing that the dielectric loss by the dielectric body 3 is constant, the radius (b) of the external conductor 2 is obtained by the unloaded Q (which is designated as $Q_u$). When the value of (b) is small, the value $Q_u$ also becomes small and the electrical loss is increased, so that radius (b) of the external conductor 2 is determined by the allowable loss. Further, the radius (a) of the inner conductor 1 is determined so that b/a=3.6 in which the value $Q_u$ becomes maximum.

FIG. 2(A), and FIG. 2(B) show a prior high frequency filter utilizing three resonators shown in FIG. 1(A) and FIG. 1(B), in which FIG. 2(A) is the plane sectional view, and FIG. 2(B) is the vertical cross-sectional view, the reference numeral 1 is an inner conductor, 2 is an outer conductor, and 3 is a dielectric body. The reference numeral 4 is a loop antenna for coupling the filter to the external connector 6. 5 is a window provided on the wall 5a which is a part of the outer conductor 2 for connection between the adjacent resonators.

However, a high frequency filter utilizing the above mentioned coaxial resonator dielectric body has the disadvantage that the manufacturing cost of the same is considerably high. The main reason for the high cost is the presence of an air cap between the inner conductor 1 and the dielectric body 3, and between the outer conductor 2 and the dielectric body 3. Of course, it is desirable that said air gap does not exist for proper operation of the filter.

FIG. 3(A) and FIG. 3(B) show the practical structure of a filter, in which an air gap 1*a* exists between the inner conductor 1 and the dielectric body 3, and an air gap 2*a* exists between the outer conductor 2 and the dielectric body 3. Those air gaps 1*a* and 2*a* are inevitable in a prior filter manufacturing system, in which a hollow cylindrical dielectric body 3 made of ceramics is inserted in the ring shaped space between the inner conductor 1 and the outer conductor 2. The presence of the air gaps 1*a* and 2*a* reduce the effective dielectric constant $\epsilon_r$ of the dielectric body 3, and further, the small drift or change of the width of the air gaps 1*a* and 2*a* changes the resonance frequency $f_O$ of a resonator considerably. Those matters will be mathematically analyzed in accordance with FIG. 4 and FIG. 5.

FIG. 4 shows the mathematical model of a resonator, in which (a) is the racius of the inner conductor 1, (b) is the radius of the outer conductor 2, Δa is the width of the inside air gap 1*a*, Δb is the width of the outside air gap 2*a*, the area I and III are air spaces provided by said air gaps 1*a* and 2*a*, respectively, and the area II is the space occupied by the dielectric body 3.

The change Δf of the resonance frequency $f_O$ of the resonator in FIG. 4 is given by the formula (2), providing that the change of the inductance (L) of the l portion of the coaxial cable by the presence of the air gaps is neglected.

$$\frac{\Delta f}{fo} = \frac{\epsilon r}{2} \cdot \frac{\left(\frac{\Delta a}{a} + \frac{\Delta b}{b}\right)}{\log \frac{b}{a}} \qquad (2)$$

For example, a=2.8 mm, b=10 mm, and $\epsilon_r$=20 are assumed in the formula (2), the following relationship is satisfied.

$$\frac{\Delta f}{fo} = 7.8\left(\frac{\Delta a}{2.8} + \frac{\Delta b}{10}\right) \qquad (3)$$

As apparent from the above formula (3), the presence of 1% change of the air gaps $$\left(\frac{\Delta a}{2.8} + \frac{\Delta a}{10} = 0.01\right)$$

due to a manufacturing error in the inner conductor 1, the outer conductor 2 and the dielectric body 3, provides 7.8% of the change of the resonance frequency $f_O$. According to our experiment in the 900 $MH_z$ band, the presence of 1% of the air gaps provided the change of the resonant frequency in the range of 3%–10%. The change of the resonant frequency $f_O$ depends upon the arrangement of the inner and the outer conductors, that is to say, the arrangement in FIG. 4 provides a larger change of the resonant frequency, and the arrangement in FIG. 5 in which the inner conductor is eccentrically positioned provides the smaller change of the resonant frequency.

In a prior high frequency filter, a conductor screw 7 in FIG. 3 is provided to compensating for the change $\Delta f$ of the resonant frequency $f_O$. For instance, the insertion of the conductor screw 7 by 10 mm in the filter having the size a=2.8 mm, b=10 mm, $\epsilon_r=20$ and the radius $a_1$ of the screw 7 is 2 mm, provides a 70 $MH_z$ change of the resonant frequency in the 900 $MH_z$ band. In this case, the formula (4) is satisfied from the above formula (3) and assuming that the ratio $\Delta a$; $\Delta b=1;3$, then the allowable errors are $2\Delta a=30$ $\mu$m, and $2\Delta b=90$ $\mu$m.

$$\frac{\Delta a}{2.8} + \frac{\Delta b}{10} = \frac{70}{900} \div 7.8 = 0.01 \quad (4)$$

As apparent from the above mathematical analysis, a prior high frequency filter having coaxial cable type filters leaves small tolerance for manufacturing error.

In order to overcome the above drawback, the improvement of a filter has been proposed, in which the air gaps 1*a* and 2*a* are eliminated. According to said improvement, thin film electrodes are either printed on the outer and the inner surfaces of the dielectric body 3, or connected to the outer and the inner conductors by conductive adhesives. However, those proposals have the disadvantage that the effective $Q_u$ of a resonator is considerably reduced due to the resistance loss by the printed electrodes and/or the adhesives.

Accordingly, the tolerance for manufacturing error in a prior high frequency filter is very severe, therefor, the manufacturing cost of a prior filter is high.

SUMMARY OF THE INVENTION

It is an object, therefore, of the present invention to overcome the disadvantages and limitations of a prior high frequency filter by providing a new and improved high frequency filter.

It is also an object of the present invention to provide a high frequency filter which does not require high accuracy in the manufacturing process.

The above and other objects are attained by a high frequency filter comprising a conductive housing, at least one resonator fixed in said housing, an input coupling means of a resonator to an external circuit, an output coupling means of a resonator to an external circuit, electromagnetic coupling means between each adjacent resonators, each resonator comprising an inner conductor one end of which is fixed at the bottom of said housing and the other end of which is free standing, a cylindrical dielectric body surrounding said inner conductor, the cross section of said inner conductor being circular, and the thickness of said dielectric body being enough to hold the electromagnetic energy in the dielectric body.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

First, the electromagnetic field of a resonator will be explained to simplify understanding of the present invention.

Figure 1:
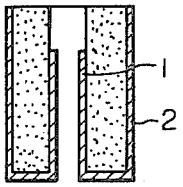
Fig. 1 (A) PRIOR ART
FIG. 1(A) and FIG. 1(B) are a vertical sectional view and plane sectional view of the prior coaxial line type resonator, respectively.
Figure 1:
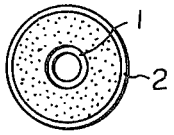
Fig. 1 (B) PRIOR ART
Figure 2:
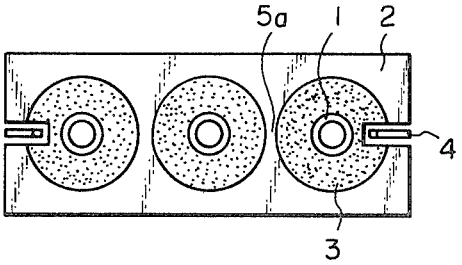
Fig. 2 (A) PRIOR ART
FIG. 2(A) and FIG. 2(B) are a plane sectional view and vertical sectional view of the prior high frequency filter utilizing the resonator in FIGS. 1(A) and 1(B), respectively.
Figure 2:
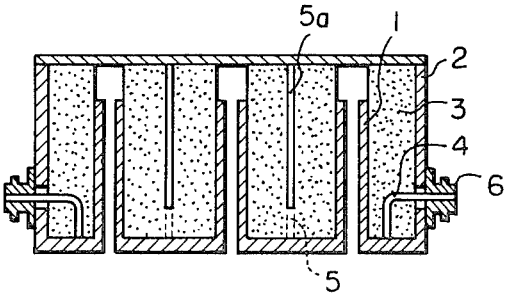
Fig. 2 (B) PRIOR ART
Figure 3A:
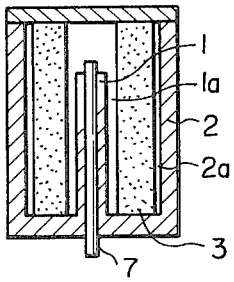
Fig. 3(A) PRIOR ART
FIG. 3(A) and FIG. 3(B) are a vertical sectional view and plane sectional view of the prior coaxial line type resonator, respectively, and are the drawings for the explanation of the effect of the air gap generated by manufacturing error.
Figure 3B:
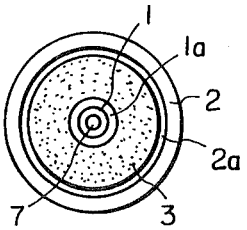
Fig. 3(B) PRIOR ART
Figure 4:
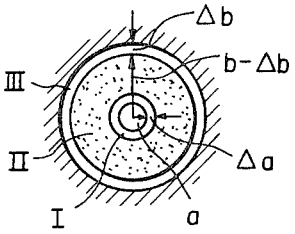
Fig. 4 PRIOR ART
FIG. 4 and FIG. 5 show models of the resonator for mathematical analysis.
Figure 5:
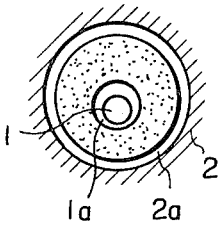
Fig. 5 PRIOR ART
Figure 6:
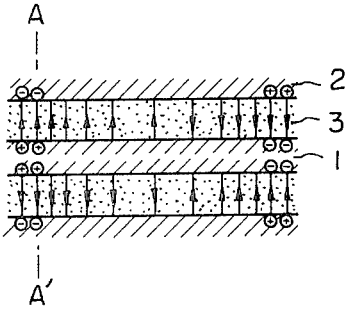
Fig. 6 (A) PRIOR ART
FIG. 6(A) and FIG. 6(B) are a vertical sectional view and plane sectional view of the prior coaxial line, respectively, and show the electromagnetic field in said coaxial line.
Figure 6B:
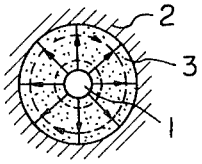
Fig. 6(B) PRIOR ART

FIG. 6(A) shows the electromagnetic field of the prior coaxial line type resonator, and FIG. 6(B) shows the electromagnetic field at the sectional view at line A—A' of FIG. 6(A). In those figures, the vector shown by the solid lines shows the electric field, the dotted line vector shows the magnetic field, and (+) and (−) symbols show the positive and negative charges respectively. From those figures, it is apparent that all the electric vectors originating as positive electric charges (+) at the surface of the inner conductor 1 become negative electric charges at the surface of the outer conductor 2, and there exists an electrostatic capacity between the positive and negative charges. And as mentioned before in accordance with FIG. 4 and the formula (2), the presence of an air gap between the inner conductor and the dielectric body, and/or between the dielectric body and the outer conductor, reduces the capacity. The mode of the electromagnetic field shown in FIGS. 6(A) and 6(B) is called the TEM mode, in which an inner conductor 1 and an outer conductor 2 play essentially equal roll to propagate the electromagnetic field energy.

Figure 7A:
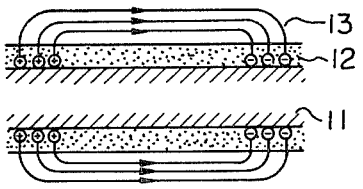
Fig. 7(A) PRIOR ART
FIG. 7(A) and FIG. 7(B) are a vertical sectional view and plane sectional view of the prior Goubou line, respectively.
Figure 7B:
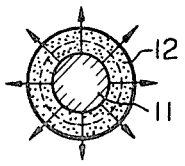
Fig. 7(B) PRIOR ART

FIG. 7(A) and FIG. 7(B) show the prior Goubou line (which is sometimes called the G-line), which is a kind of a surface transmission line and is utilized for VHF television signal transmission. The G-line has a conductor line 11 covered with a thin dielectric layer 12, and the electromagnetic wave propagates along the layer 12. The electromagnetic mode of the G-line is called the $TM_{01}$ surface wave mode. In a G-line, no outer conductor is necessary.

However, it should be noted that the electromagnetic energy in a G-line propagates in the space 13 along the dielectric layer 12, therefore, the dielectric constant of the G-line is substantially defined by the dielectric constant of the air, and not by the dielectric body 12, thus, the dielectric constant of a G-line along the path of the energy is generally rather small, and although attempts have been made to form a resonator utilizing a G-line, such as resonator must be very large.

Figure 8A:
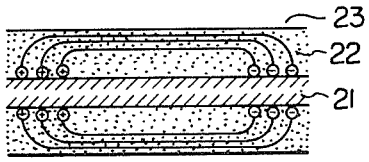
FIG. 8(A) and FIG. 8(B) are a vertical sectional view and plane sectional view, respectively, of the dielectric line according to the present invention.
Figure 8B:
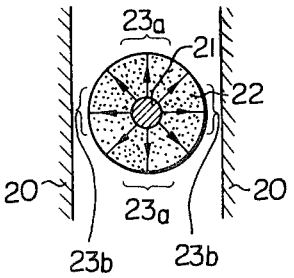

FIG. 8(A) and FIG. 8(B) show the improvement of said G-line. The improved line has an inner conductor 21 covered with the dielectric body 22 held between two parallel conducting plates 20 which doubles as metal housing. The diameter of the dielectric body 22 is approximately four times as large as that of the inner conductor 21. Due to the thick dielectric body 22, the electric vectors around the central area 23*a* in the open spaces 23 originating from positive electric charges at the surface of the inner conductor 21 become negative electric charges at the surface of the inner conductor 21 through the dielectric layer 22. The electric vectors around the edge area 23*b* in the open space 23 originating from positive electric charges on the inner conductor 21 become negative electric charges on the outer conductor 20. The mode of the electromagnetic field in FIGS. 8(A) and 8(B) is called coupled mode between the TEM and the $TM_{10}$ mode.

The present invention employs a resonator utilizing the improved dielectric line shown in FIGS. 8(A) and 8(B), and the present reasonator has the advantures listed below.

(a) Almost all the electromagnetic energy is closed within the dielectric body 22 and so the leakage energy outside the open space 23 is very weak. Therefore, the effective dielectric constant of the line is approximately equal to the dielectric constant of the dielectric body, so a small size resonator can be obtained.

(b) Since merely plate conductors are necessary, and there is small resistance loss due to the electric current in an outer conductor, the value Qu which is the value of Q on the unload condition can be larger than that of a prior resonator, when said improved line is utilized as a resonator.

Figure 9:
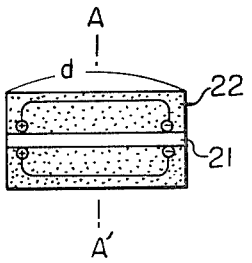
FIG. 9 shows the structure of the ½ wavelength resonator utilizing the dielectric line in FIGS. 8(A) and 8(B)

FIG. 9 shown the structure of the present resonator, which is the embodiment of a ½ wavelength resonator, and utilizes the improved dielectric line shown in FIGS. 8(A) and 8(B). The resonator in FIG. 9 comprises the outer conductor 20 (not drawn in the figure), the inner conductive 21 covered with the dielectric body 22 and the length (d) of the inner conductor 21 of the resonator is determined by the following formulae;

$$d = \frac{1}{2}\lambda g \qquad (5)$$
$$\lambda g \approx \frac{1}{\sqrt{\epsilon_r}}\lambda o$$
$$fo = \frac{C}{\lambda o}$$

Figure 10:
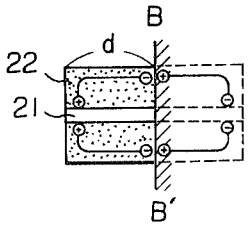
FIG. 10 is shows the structure of the ¼ wavelength resonator utilizing the dielectric line in FIGS. 8(A) and 8(B), FIG. 11(A) and FIG. 11(B) are a plane sectional view and vertical sectional view, respectively, of the first embodiment of the high frequency filter according to the present invention.

FIG. 10 is the structure of another resonator according to the present invention, in which a ¼ wavelength resonator is provided. The resonator in FIG. 10 also has the outer conductor 20, an inner conductor 21 covered with the thick dielectric body 22, and the length (d) of the inner conductor 21 is determined by the following formuae;

$$d = \frac{1}{4}\lambda g \qquad (6)$$
$$\lambda g = \frac{1}{\sqrt{\epsilon_r}}\lambda o$$
$$fo = \frac{C}{\lambda_o}$$

The symbols $\lambda_g$, $\epsilon_r$, $\lambda_o$, $f_o$ and C in the formulae (5) and (6) indicate the wavelength in the line, the dielectric constant of the dielectric body 22, the wavelength in free space, the resonant frequency, and the light velocity respectively. The ¼ wavelength reasonator in FIG. 10 can be obtained by positioning a conductor plane B—B' at the line A—A' which is the center of the resonator of FIG. 9, and omitting the right half of the resonator in FIG. 9.

Concerning the value of Q of the resonator according to the present invention, the result of our experiment in which the diameter of the dielectric body is 20 mm, the diameter of the inner conductor is 5.6 mm, value $\epsilon_r$ of the dielectric body is 20, and the frequency is 900 $MH_z$, shows that the value $Q_u$ of the resonator in FIG. 9 is 2,000, and the value $Q_u$ of the resonator in FIG. 10 is 1,800. Therefore, the value of Q of the present resonator is higher than a prior coaxial cable type resonator which utilizes the TEM mode.

Further, the experiment shows that no undesirable spurious resonance occurs at less than 2,100 $MH_z$ in FIG. 10. Accordingly, it is quite apparent that a high frequency filter utilizing the resonators in FIG. 9 and/or FIG. 10 can be obtained, and said filter can be small in size and is excellent in electrical characteristics.

Now, some embodiments of high frequency filters utilizing the resonators in FIG. 9 and/or FIG. 10 will be explained.

Figure 11A:
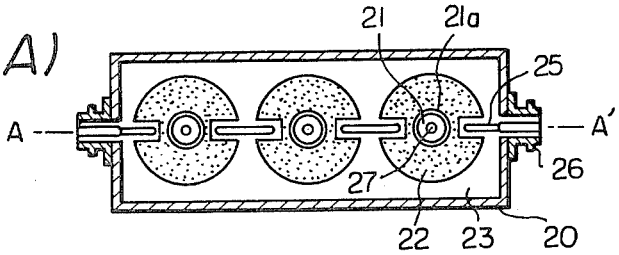
Figure 11B:
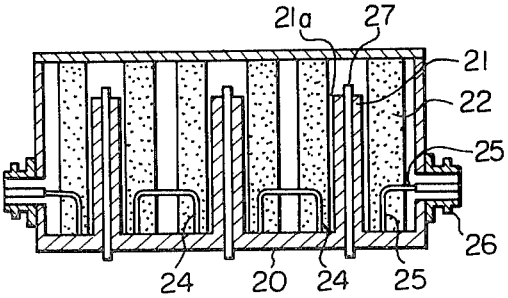

FIG. 11(A) and FIG. 11(B) show the embodiment of the present high frequency filter, in which three resonators are utilized, and FIG. 11(A) is the plane sectional view and FIG. 11(B) is the vertical sectional view at the line A—A' in FIG. 11(A). It should be appreciated that the present resonator does not utilize an outer conductor, but has only a conductor housing 20 which functions as a shield. This structure reduces the manufacturing cost considerably and increases the value $Q_u$ of the resonator by reducing loss in the resonator. The present high frequency filter has a plurality of ¼ wavelength resonators each of which has an inner conductor 21. The extreme end of said inner conductor 21 is fixed and short-circuited to the bottom of said conductor housing 20, and the other end of said inner conductor 21 is open in the free space. The thick cylindrical dielectric body 22 surrounds the inner conductor 21. Further, a loop antenna 24 is provided near each fixed end of each inner conductors for coupling between each resonator. In those figures, the reference numeral 21*a* is an air gap between the inner conductor 21 and the dielectric body 22, 25 is a loop antenna for coupling with an external device, 26 is a connector, 27 is a control screw for frequency adjustment, and 23 shows the free space outside the ¼ wavelength resonators. It is preferred that the dielectric body is efficiently thick, and the diameter of the dielectric body is preferably larger than four times as large as that of the inner conductor so that most of the electromagnetic energy is maintained in the dielectric body itself.

Figure 12A:
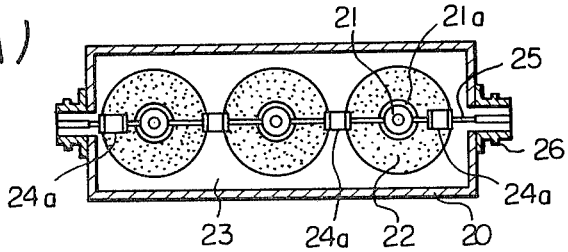
FIG. 12(A) and FIG. 12(B) are a plane sectional view and vertical sectional view, respectively, of the second embodiment of the high frequency filter according to the present invention.
Figure 12B:
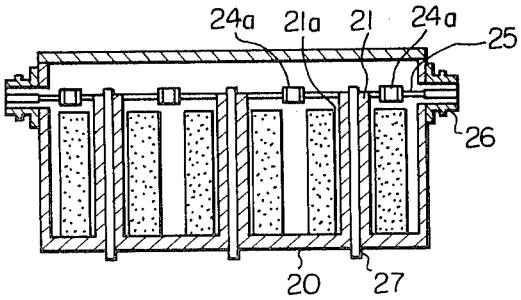

FIGS. 12(A) and 12(B) show another high frequency filter according to the present invention utilizing ¼ wavelength resonators, and FIG. 12(A) is a plane sectional view and FIG. 12(B) is a vertical sectional view. The feature of the embodiment of FIGS. 12(A) and 12(B) resides in that a coupling capacitor 24*a* is provided between each adjacent inner conductor of each adjacent resonator, and between the inner conductor of the extreme end resonator and the external line. Said capacitor is connected at the open end of each inner conductor. It should be appreciated that the connection between each resonator and/or between the resonator and/or between the resonator and the external circuit is performed by said capacitor 24*a*, while that connection in the embodiment in FIGS. 11(A) and 11(B) is performed by the loop antennas.

Figure 13A:
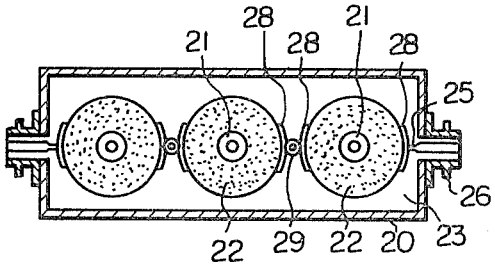
FIG. 13(A) and FIG. 13(B) are a plane sectional view and vertical sectional view, respectively of the third embodiment of the high frequency filter according to the present invention.
Figure 13B:
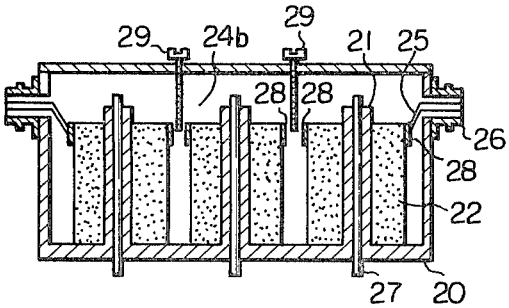

FIGS. 13(A) and 13(B) show another embodiment of the high frequency filter according to the present invention, utilizing ¼ wavelength resonators, and FIG. 13(A) is a plane sectional view and FIG. 13(B) is a vertical sectional view. The feature of the embodiment in FIG. 13(A) and FIG. 13(B) resides in the coupling means, which comprises an electrode 28 on the surface of a dielectric body 22 and a capacitance 24*b* provided between the electrode 28 and the inner conductor 21 of the adjacent resonator. The electrode 28 is provided as shown in the figures so that each electrode of the adjacent resonators confront each other, and the extreme ends of the electrodes are connected directly to an external circuit. In this embodiment, preferably, a control screw 29 which is slidably positioned between a pair of confronting electrodes is provided for fine adjustment of the capacitance between electrodes 28.

Figure 14A:
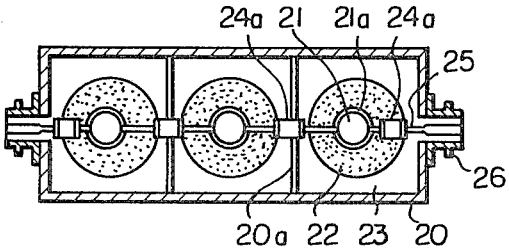
FIG. 14(A) and FIG. 14(B) are a plane sectional view and vertical sectional view, respectively, of the fourth embodiment of the high frequency filter according to the present invention.
Figure 14B:
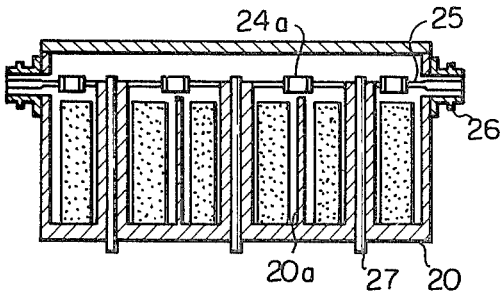

FIG. 14(A) and FIG. 14(B) show the improvement of the embodiment of FIG. 12(A) and FIG. 12(B), and FIG. 14(A) is the plane sectional view, and FIG. 14(B) is the vertical sectional view. The feature of this embodiment resides in the presence of the conductive wall 20*a* between each resonator for eliminating stray coupling between the adjacent resonators. Said conductive wall 20*a* is electrically connected to the housing 20, and extends from the bottom of the housing 20 to the portion near the capacitor 24*a*.

Figure 15:
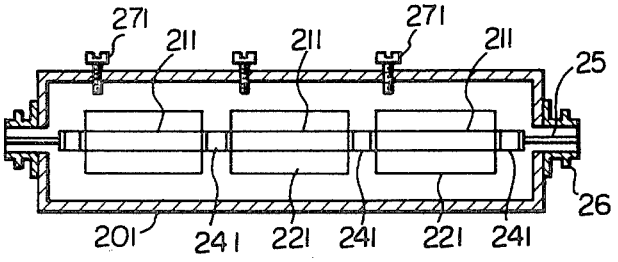
FIG. 15 is the fifth embodiment of the high frequency filter utilizing ½ wavelength resonators according to the present invention.

FIG. 15 is still another embodiment of the high frequency filter according to the present invention, and utilizes three ½ wavelength resonators shown in FIG. 9. The resonator utilized in the filter in FIG. 15 comprises the shield housing 201, three inner conductors 211 separated from one another, dielectric body 221 surrounding said inner conductors, and coupling capacitors 241 inserted between the inner conductors and between the extreme end of the inner conductor and the external circuit. The reference numeral 271 is the frequency control screw for adjusting the resonant frequency of each resonator.

It should be appreciated that the present high frequency filter utilizing the novel resonator has the advantages that (a) the outer conductor of a prior coaxial line type resonators is unnecessary, and a simple outer conductor plates are sufficient, (b) the resonator loss is smaller than that utilizing a prior resonator, and further, (c) a filter and/or the resonator with small size, low price, light weight, and excellent electrical characteristics can be obtained. Further, it should be appreciated that the present resonator is even smaller than a prior dielectric resonator which operates in the TEM mode. Still another advantage of the present invention is that the allowable error for the diameter of an inner conductor is not severe, and the manufacturing process of an inner conductor is simple.

Now, some another embodiments of the high frequency filter according to the present invention will be explained in accordance with FIG. 16 through FIG. 20. Those embodiments concern improvements of the electrical and/or magnetic coupling between each adjacent resonators.

First, the coupling coefficient $K_{ij}$ between the resonators is theoretically shown in the formula (7) below.

$$K_{ij} = \frac{1 - \frac{C_e}{C_o}}{1 + \frac{C_e}{C_o}} \tag{7}$$

where $C_o$ is the coupling amount by electric coupling, and $C_e$ is the coupling amount by magnetic coupling, and $K_{ij}$ is the coupling coefficient between two resonators. It should be noted from the formula (7) that when $C_o$ is equal to $C_e$, the value $K_{ij}$ becomes zero.

Figure 16:
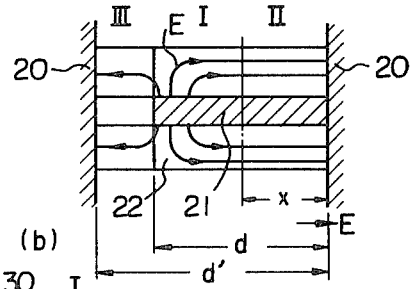
FIG. 16 shows the pattern of the electromagnetic field in the ¼ wavelength resonator according to the present invention.

FIG. 16 shows the pattern of the electromagnetic field in the ¼ wavelength resonator according to the present invention. In FIG. 16, one end of the inner conductor 21 is fixed to the conductor housing 20, and the other end of the inner conductor 21 stands in the open space. The dielectric body 22 surrounds the inner conductor 21. In that figure, in the region (I) near the open end of the inner conductor 21, there exists a strong electric field in the radial direction, and in the region (II) near the fixed end of the inner conductor 21, there exists a strong magnetic field in the circumferential direction. In the region between the open end of the inner conductor and the conductor housing, the electric and/or magnetic field is weaker than that of the regions (I) or (II). Accordingly, it is apparent that the region (I) provides the electric coupling between two resonators and the region (II) provides the magnetic coupling between two adjacent resonators.

FIG. 17(A) shows the structure of the coupling between two resonators, in which each resonator with an inner conductor 21 covered with a dielectric body 22 is mounted in a conductive shield housing 20, and a straight conductive wire 30 is provided in the region (I) near the open end of the inner conductor between the walls of the conductive housing 20. Said wire 30 is perpendicular to the arrangement of the resonators as shown in the figure. In that structure, the electric field along the wire 30 is short-circuited by said wire 30, which does not affect the electric field component perpendicular to that wire 30. Accordingly, the electric coupling coefficient $C_o$ is increased and the coupling coefficient $K_{ij}$ in the formula (6) is increased.

Figure 17:
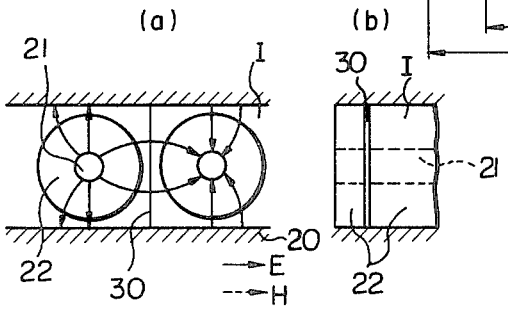
FIG. 17(A) shows the embodiment of the coupling between two resonators according to the present invention.
FIG. 17(B) shows another embodiment of the coupling between two resonators according to the present invention.
Figure 17B:
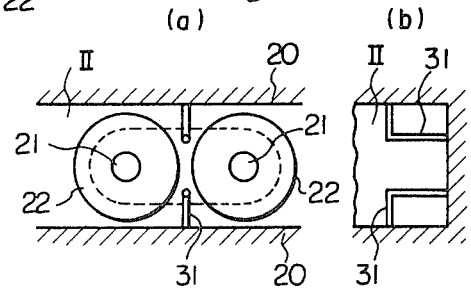

FIG. 17(B) shows another structure of the coupling between two resonators, in which the magnetic coupling $C_e$ is increased. In FIG. 17(B), a pair of conductor loop antennas 31 are provided in the region (II) between two adjacent resonators. The conductor loop antenna is provided between the bottom and the side wall of the conductive housing as shown in FIG. 17(B). It is apparent to those skilled in the art that the loop antenna increases the magnetic coupling coefficient between two adjacent resonators, and thereby increases the coupling coefficient $K_{ij}$.

Figure 18:
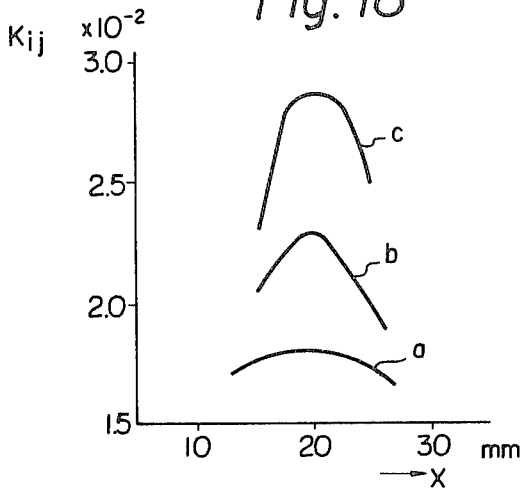
FIG. 18 shows the curve of the coupling coefficient of the resonator in FIG. 17(A), FIG. 19(A) and FIG. 19(B) are a plane sectional view and vertical sectional view, respectively, of the sixth embodiment of the high frequency filter according to the present invention.

FIG. 18 shows the curve of the experimental result of the coupling coefficient $K_{ij}$ when the conductive wire 30 in FIG. 17(A) is provided. In FIG. 18, the horizontal axis shows the length (x) between the bottom of the conductive housing 20 and the conductive wire 30 as shown in FIG. 16, and the vertical axis shows the value of the coupling coefficient $K_{ij}$. The curve (a) is the characteristic when a single conductive wire is provided, and the curves (b) and (c) are the characteristics when two wires are provided, respectively. The conditions of the experiment in FIG. 18 are that the diameter of the inner conductor is 5.6 mm, the diameter of the dielectric body is 20 mm, the diameter of the conductive wire 30 is 0.6 mm, the frequency is 900 $MH_z$, the length of the inner conductor (d) is 20 mm, and the length (d') between the conductive walls of the housing is 30 mm. It is apparent from FIG. 18 that the coupling coefficient $K_{ij}$ when the conductive wire 30 is provided is considerably larger than that with no conductive wire, and an increases in the number of the conductive wires increases that coupling coefficient $K_{ij}$. Also, it should be appreciated that the coupling coefficient $K_{ij}$ is maximum when the conductive wire 30 is positioned at the open end of the inner conductor, and when said wire is positioned apart from the open end of the inner conductor the coupling coefficient is decreased. That experimental result coincides with the theoretical analysis.

Figure 19A:
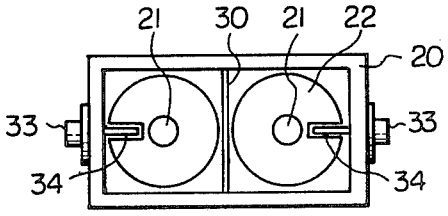
Figure 19B:
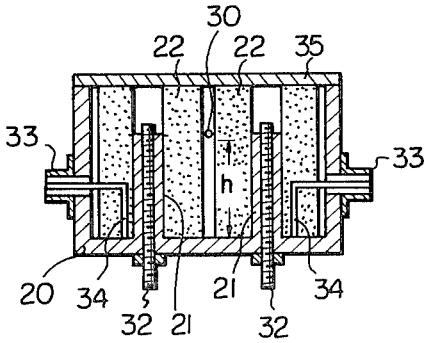

FIG. 19(A) and FIG. 19(B) show the practical embodiment of the high frequency filter according to the present invention utilizing the coupling increase means mentioned above. FIG. 19(A) is the plane sectional view, and FIG. 19(B) is the vertical sectional view, in which the embodiment with two resonators is disclosed. Each resonator in this embodiment comprises a conductive housing 20, the inner conductor 21 mounted at the bottom of said housing 20, and the dielectric body 22 surrounding the inner conductor 21. Said conductive body 22 is fixed on the bottom of the housing 20. The length (d) of the inner conductor 21 is approximate ¼ of the wavelength $\lambda_g$. Also, some conductive wires 30 are provided between the resonators for increasing the coupling coefficient $K_{ij}$. Said conductive wire is positioned near the open end of the inner conductor so that it is perpendicular to the inner conductor and parallel to the bottom plane of the housing 20. The embodiment shows the case of three conductive wires. The frequency control screw 32 is inserted in the inner conductor 21 so that the length of the inner conductor is substantially adjusted to control the resonant frequency. At the input and the output of the filter, connection 33 are provided, and loop antennas 34 are provided between said connectors and each resonator to connect the filter to an external circuit. Said loop antenna is inserted in the dilelctric body to excite the resonators. The reference numeral 35 is a conductive cap covering the housing 20.

According to the embodiment in FIG. 19(A) and FIG. 19(B), the desired electrical coupling can be easily obtained by adjusting the position (the length (h) in FIG. 19(B)) and the number of the conductive wires. Further, it should be appreciated that said conductive wires can be replaced by a conductive plate provided between two resonators, perpendicular to each inner conductor and are parallel to the bottom of the housing. Our experiment showed that the conductive plate provided the equal effect as that of the conductive wires.

Figure 20A:
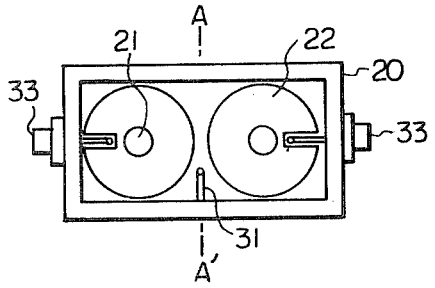
FIG. 20(A) is a plane view of the seventh embodiment of the high frequency filter according to the present invention.
Figure 20B:
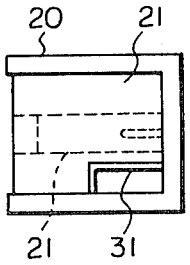
FIG. 20(B) is a cross sectional view at the line A—A′ of FIG. 20(A), FIG. 21(A) and 21(B) are a plane sectional view and vertical sectional view, respectively, of the modification of the resonator according to the present invention.

FIGS. 20(A) and 20(B) show still another embodiment of the high frequency filter according to the present invention. FIG. 20(A) is the plane sectional view and FIG. 20(B) is the vertical sectional view at the line A—A' of FIG. 20(A). The advantage of the embodiment in FIGS. 20(A) and 20(B) over the previous embodiment is the presence of the loop antenna 31, instead of the conductive wire 30, and the same reference numerals are given as those of the previous embodiment. In FIG. 20(A) and FIG. 20(B), a single loop antenna 31 is provided although FIG. 17(B) showed the embodiment with twin loop antennas. In the present embodiment, the coupling between two resonators is provided through magnetic coupling by the presence of the loop antenna. Of course when the coupling coefficient is not large enough two loop antennas are utilized as shown in FIG. 17(B).

Next, some modifications of the resonator for employment in the present high frequency filter will be described in accordance with FIGS. 21 through 26.

Figure 21A:
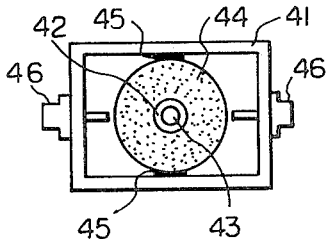
Figure 21B:
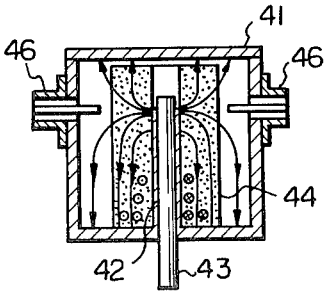
Figure 22A:
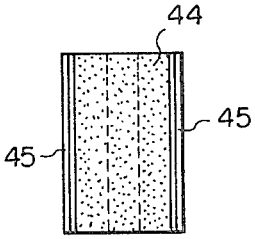
FIG. 22(A) and FIG. 22(B) are a vertical sectional view and plane sectional view, respectively, of the dielectric body and the attached electrodes of the resonator in FIGS. 21(A) and 21(B)
Figure 22B:
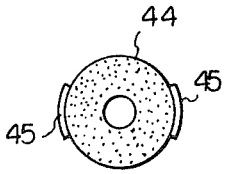
Figure 23:
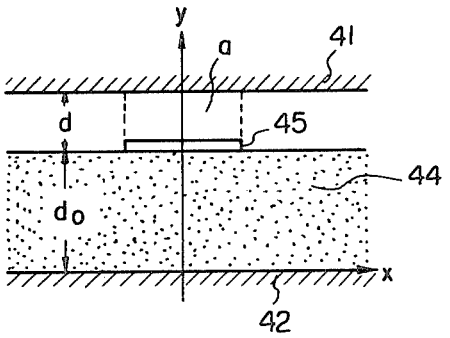
FIG. 23 is the model for mathematical analysis of the resonator in FIGS. 21(A) and 21(B)

FIGS. 21(A) and 21(B) show the modification of the present resonator utilizing a ¼ wavelength dielectric line, in which FIG. 21(A) is the plane sectional view, and FIG. 21(B) is the vertical sectional view. Also, FIG. 22(A) is the vertical sectional view of the dielectric body having an electrode attachment utilized in the resonator in FIGS. 21(A) and 21(B), and FIG. 22(B) is the plane sectional view of the body in FIG. 22(A). In those figures, the reference numeral 41 is a conductive metal housing which doubles as an earth conductor, 42 is an inner conductor mounted in said housing. The length of said inner conductor 42 is $\frac{1}{4}$ λg (λg is the wavelength in the line), one end of said inner conductor 42 is fixed at the bottom of the metal housing 41, and the other end of said inner conductor 42 stands free. The inner conductor 42 has a hollow, into which a frequency adjust screw 43 is inserted through the bottom wall of the housing 41. The cylindrical dielectric body 44 surrounds the inner conductor 42. Further, a pair of electrodes 45 are attached at the surface of the dielectric body 44 as shown in the figures. The electrodes 45 have the predetermined width and the predetermined length, and are fixed on the surface of the dielectric body 44 through bonding. Preferably, the electrodes are attached at both the extreme ends of the diameter of the dielectric body and confront each other. Those electrodes are electrically connected to the housing 41.

The mode of the electromagnetic flux in the resonator of FIG. 21(A) is shown in FIG. 21(B), in which a solid line shows electric flux, and the symbols ⊕ and⊙ show magnetic flux. Although there exists an electromagnetic flux outside the dielectric body since the infinite value of the dielectric constant of the dielectric body 44 is not obtained, the electromagnetic flux outside the dielectric body 44 is negligibly small, as the flux is an Evanecent were which decreases rapidly with distance from the surface of the dielectric body 44. Therefore, the conductive housing 41 scarcely affects the electromagnetic flux, if a thin air gap is provided between the housing 41 and the dielectric body. Accordingly, the manufacturing accuracy of the housing does not need to be strict, and the manufacturing cost of the housing can be low.

The presence of the electrodes 45 connected to the housing 41 increases the capacitance. The theoretical analysis of that feature will be explained in accordance with FIG. 23 which is the equivalent model of the parallel electrodes capacitance.

When no electrode 45 is provided, the capacitance (C) between the parallel electrodes 41 and 42 for each unit area is shown below;

$$C = \frac{\epsilon_o \cdot \epsilon_r}{d_o + \epsilon_{rd}} \tag{8}$$

where $\epsilon_o$ is the dielectric constant of the air or the vacuum condition, $\epsilon_r$ is the relative dielectric constant of the dielectric body 44, $d_o$ is the width of the dielectric body 44, d is the length between the surface of the dielectric body 44 and the conductive housing 41.

On the other hand, when electrodes 45 are provided on the surface of the dielectric body 44 and the electrodes are connected to the conductive housing 41 electrically through the portion (a), the capacitance (c') between the parallel electrodes 41 and 42 for each unit area is shown below;

$$C' = \frac{\epsilon_o \cdot \epsilon_r}{d_o} \tag{9}$$

Accordingly, the amount of the increase of the capacitance by the presence of the electrodes is shown below.

$$c' - c = \frac{\epsilon_o \epsilon_r^2 d}{d_o^2 + \epsilon_r d d_o} \approx \frac{\epsilon_o \epsilon_r^2 d}{d_o^2} \tag{10}$$

In the formula (10), it is assumed that $d/d_o << 1$ is satisfied. The increase of the capacitance lowers the resonant frequency of the resonator. Therefore, for a predetermined resonant frequency, the presence of the electrodes reduces the size of the resonator.

It is apparent that the total increment $\Delta C_t$ of the capacitance when the electrode 45 has the area (S) is the product of the (c'−c) in the formula (10) and the area (S), and is shown in the formula (11).

$$\Delta C_t = \frac{\epsilon_o \epsilon_r^2 d}{d_o^2} S \tag{11}$$

Accordingly, by adjusting the width and/or the length of the electrode 45, the total capacitance and/or the resonant frequency of the resonator can be controlled.

Figure 24:
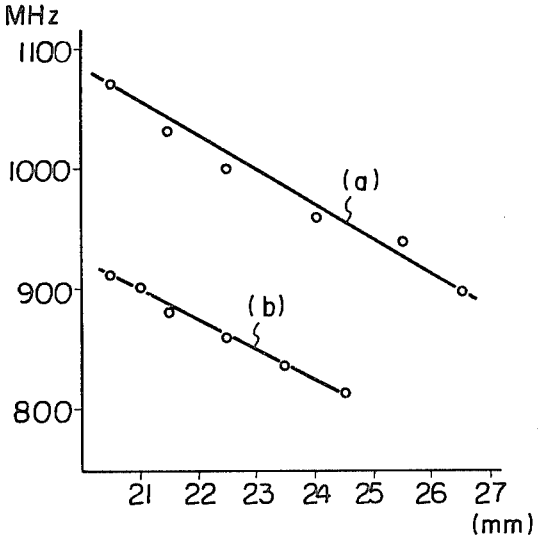
FIG. 24 shows the curve of the experimental result of the resonator in FIGS. 21(A) and 21(B)
Figure 25:
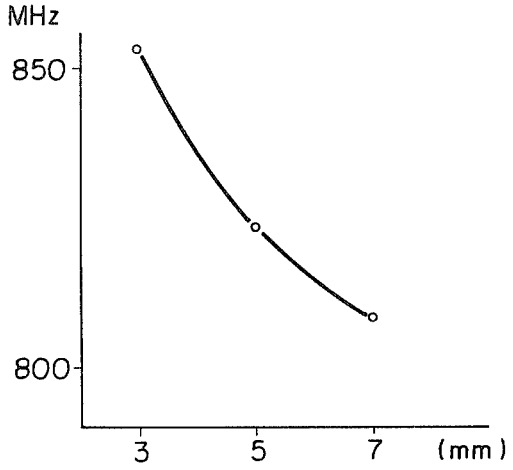
FIG. 25 is the other curve of the experimental result of the resonator in FIGS. 21(A) and 21(B), and FIG. 26(A) and FIG. 26(B) are a vertical sectional view and plane sectional view, respectively, of the other modification of the resonator with in FIGS. 21(A) and 21(B).

The experimental result concerning the presence of the electrodes 45 is shown in FIGS. 24 and 25. In FIG. 24, the horizontal axis shows the length (mm) of the inner conductor 42, and the vertical axis shows the resonant frequency in $MH_z$. The curve (a) shows the resonant frequency characteristics when no electrode is provided, and the curve (b) shows the resonant frequency characteristics when the electrodes 45 with the electrode width 3 mm is provided. Also in FIG. 25, the horizontal axis shows the width of the electrode 45, in mm and the vertical axis shows the resonant frequency in $MH_z$, and it is assumed that the length of the inner conductor 42 and the electrodes 45 is constant (=23.5 mm). Thus, FIG. 25 is the curve of the resonant frequency versus the width of the electrode. Other conditions of the experiment are that the dielectric body is the magnesium titanate with $\epsilon_r=20$, the diameter of the dielectric body is 15 mm, and the diameter of the inner conductor is 4 mm.

It is apparent that the presence of the electrodes 45 is effective, and also, by connecting the electrodes to the conductive housing through bonding or welding, the dielectric body and/or the resonator can be rigidly fixed to the housing. Accordingly, the presence of the electrodes also increases the stability of the resonator to external vibration and/or external mechanical disturbances.

Figure 26A:
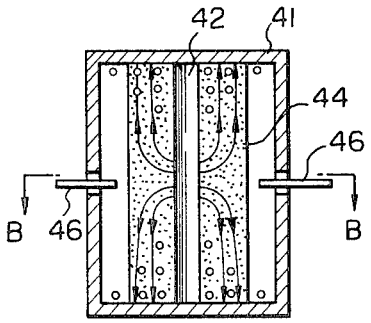
Figure 26B:
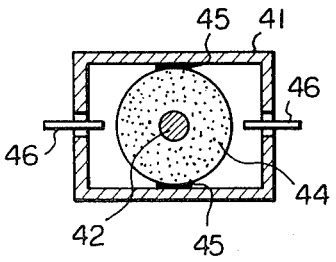

FIG. 26(A) and FIG. 26(B) show still another embodiment of the resonator according to the present invention, in which FIG. 26(A) is the vertical sectional view, FIG. 26(B) is the plane sectional view, and the operational principle of this embodiment is the resonance of the $\frac{1}{2}$ wavelength line. In those figures the arrow shows the electrical field, and the small circle shows the magnetic field. In this embodiment, the inner conductor 42 has the length of $\frac{1}{2}$ $\lambda_g$ ($\lambda_g$ is the wavelength in the line), one end of which is fixed at the top plate of the conductive housing 41, and the other end of which is fixed at the bottom plate of the conductive housing 41. The frequency control screw is not provided in this embodiment. Other structure and operation of the resonator in FIGS. 26(A) and 26(B) are the same as those in FIGS. 21(A) and 21(B).

It should be appreciated that the improved resonator having electrodes on the surface of the dielectric body can replace the resonators in the filter mentioned in FIGS. 11 through 20.

As described in detail, the present high frequency filter has novel resonators each of which has an inner conductor covered with the thick dielectric body held between parallel conducting plates. The outer conductor is not coaxial but merely plates, therefore, the allowable error in the manufacturing process is not severe, therefore, the cost of the resonator is reduced. Further, by attaching electrodes to the surface of the dielectric body, the size of a resonator is reduced. Also, the present invention provides some coupling means for electromagnetic coupling between resonators to provide a filter. The coupling coefficient between resonators is subject to the desired characteristics of a filter.

From the foregoing it will now be apparent that a new and improved high frequency filter and a resonator to be utilized in that filter have been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A high frequency filter comprising a conductive housing, at least two resonators fixed in said housing, an input means for coupling one end resonator of said at least two resonators to an external circuit, an output means for coupling the other end resonator of said at least two resonators to an external circuit, and coupling means for electromagnetically coupling each resonator, characterized in that each resonator comprises an inner conductor one end of which is fixed at the bottom of said housing, and the other end of which is free standing, wherein the length of said inner conductor is substantially ¼ wavelength, a cylindrical dielectric body surrounding said inner conductor, the thickness of said dielectric body being sufficient to hold substantially all the electromagnetic energy in the dielectric body, wherein electromagnetic energy is applied to said filter through said input means, and exits therefrom through said output means.

2. A high frequency filter comprising a conductive housing, at least two resonators fixed in said housing, an input means for coupling one end resonator of said at least two resonators to an external circuit, an output means for coupling the other end resonator of said at least two resonators to an external circuit, and coupling means for electromagnetically coupling each resonator, characterized in that each resonator comprises an inner conductor one end of which is fixed at the bottom of said housing, and the other end of which is free standing, wherein the length of said inner conductor is substantially ½ wavelength, a cylindrical dielectric body surrounding said inner conductor, the thickness of said dielectric body being sufficient to hold substantially all the electromagnetic energy in the dielectric body, wherein electromagnetic energy is applied to said filter through said input means, and exits therefrom through said output means.

3. A high frequency filter according to either lf claims 1 or 2, wherein said coupling means is a loop antenna.

4. A high frequency filter according to either of claims 1 or 2, wherein said coupling means is a capacitor.

5. A high frequency filter according to either of claims 1 or 2, wherein said coupling means is an electrode attached on the surface of said dielectric body so that said electrode confronts the electrode of the next resonator, and a conductor connected electrically to the housing extends between the electrodes.

6. A high frequency filter according to either of claims 1 or 2, wherein a conductive wall is provided between resonators to prevent stray coupling.

7. A high frequency filter according to either of claims 1 or 2, wherein said coupling means is a conductive wire provided near open end of the inner conductor, and said conductive wire is positioned perpendicular to said inner conductor.

8. A high frequency filter according to either claims 1 or 2, wherein said coupling means is a loop antenna provided near the bottom of the housing.

9. A high frequency filter according to either of claims 1 or 2, wherein said dielectric body of the resonator has an electrode on the surface of the dielectric body, and said electrode is electrically connected to the housing.

10. A high frequency filter according to either of claims 1 or 2, wherein the diameter of the dielectric body is approximately four times as large as that of the inner conductor.

11. A high frequency filter according to either of claims 1 or 2, wherein said resonator has a frequency adjust screw rotatably inserted in the inner conductor.

* * * * *